US005394291A

United States Patent [19]

Janke et al.

[11] Patent Number: 5,394,291

[45] Date of Patent: Feb. 28, 1995

[54] RELAY ENERGIZING CIRCUIT

[75] Inventors: Donald E. Janke, Benton Township, Berrien County, Mich.; Joseph M. Szynal, Laporte, Ind.; Ronald W. Guess, Scott Township, Vanderburgh County, Ind.; Greg A. Bradley, Evansville, Ind.; Randall L. Carnal, Center Township, Vanderburgh County, Ind.

[73] Assignee: Whirlpool Corporation, Benton Harbor, Mich.

[21] Appl. No.: 172,931

[22] Filed: Dec. 27, 1993

Related U.S. Application Data

[62] Division of Ser. No. 978,275, Nov. 18, 1992, Pat. No. 5,363,669.

[51] Int. Cl.[6] ..... H01H 47/10

[52] U.S. Cl. ..... 361/155; 361/194; 62/155

[58] Field of Search ..... 361/154, 155, 156, 192, 361/193, 194; 62/155, 234, 151

[56] References Cited

U.S. PATENT DOCUMENTS

| | | | |
|---|---|---|---|
| 3,643,458 | 2/1972 | Linstrongerg et al. . | |
| 3,644,693 | 2/1972 | Bitko . | |
| 3,689,808 | 9/1972 | Stampfli | 361/194 X |
| 4,156,350 | 5/1979 | Elliott et al. | 62/155 X |
| 4,251,988 | 2/1981 | Allard et al. | 62/155 X |
| 4,297,852 | 11/1981 | Brooks . | |
| 4,310,868 | 1/1982 | Lillie et al. | 361/155 X |
| 4,318,154 | 3/1982 | DePuy | 361/155 |
| 4,411,139 | 10/1983 | Bos | 62/155 X |
| 4,473,862 | 9/1984 | Hill | 361/155 |
| 4,603,370 | 7/1986 | Imazeki et al. | 361/155 |
| 4,615,179 | 10/1986 | Chin et al. . | |
| 4,698,978 | 10/1987 | Jones | 62/160 |
| 4,777,556 | 10/1988 | Imran | 361/155 |
| 4,850,204 | 7/1989 | Bos et al. | 62/234 |
| 4,850,952 | 7/1989 | Ballard . | |
| 4,884,414 | 12/1989 | Bos | 62/155 X |
| 4,914,315 | 4/1990 | Nickolai . | |
| 4,937,544 | 6/1990 | Mueller . | |
| 4,956,623 | 9/1990 | Rolf-Dieter . | |
| 4,972,133 | 11/1990 | Hirota et al. . | |

*Primary Examiner*—Harry B. Tanner

[57] ABSTRACT

A method of energizing a relay comprising the steps of applying an energization signal to the relay having a voltage in excess of a rated voltage of the relay and then allowing the energization voltage to rapidly decay to a level within the rated voltage of the relay.

11 Claims, 5 Drawing Sheets

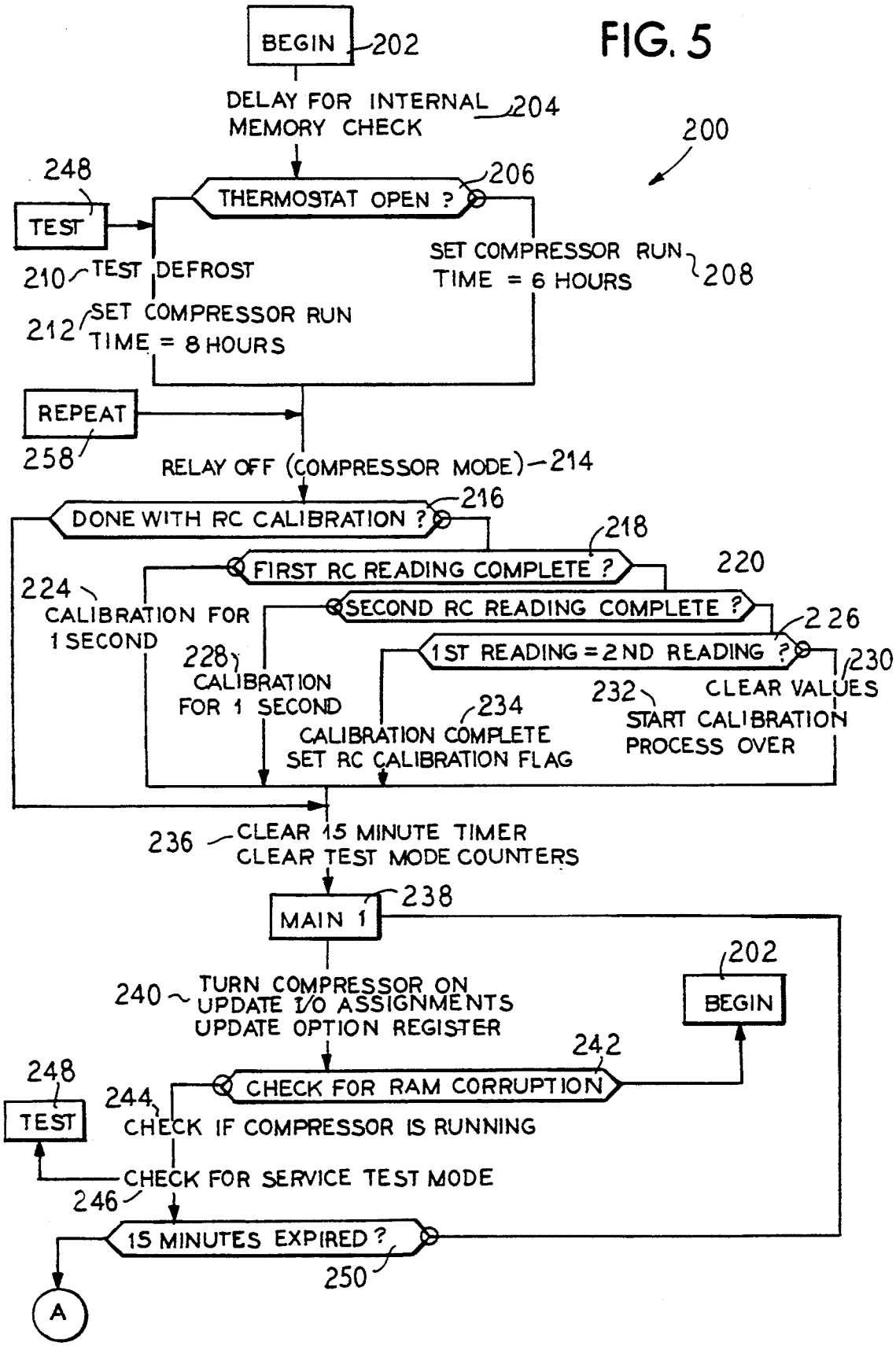
FIG. 5
BEGIN
202
DELAY FOR INTERNAL MEMORY CHECK
204
200
248
TEST
THERMOSTAT OPEN ?
206
210
TEST DEFROST
SET COMPRESSOR RUN TIME = 6 HOURS
208
212
SET COMPRESSOR RUN TIME = 8 HOURS
REPEAT
258
RELAY OFF (COMPRESSOR MODE)
214
DONE WITH RC CALIBRATION ?
216
218
FIRST RC READING COMPLETE ?
220
224
CALIBRATION FOR 1 SECOND
SECOND RC READING COMPLETE ?
226
228
CALIBRATION FOR 1 SECOND
1ST READING = 2ND READING ?
230
CLEAR VALUES
232
START CALIBRATION PROCESS OVER
234
CALIBRATION COMPLETE SET RC CALIBRATION FLAG
236
CLEAR 15 MINUTE TIMER CLEAR TEST MODE COUNTERS
MAIN 1
238
202
BEGIN
240
TURN COMPRESSOR ON UPDATE I/O ASSIGNMENTS UPDATE OPTION REGISTER
242
CHECK FOR RAM CORRUPTION
248
TEST
244
CHECK IF COMPRESSOR IS RUNNING
CHECK FOR SERVICE TEST MODE
246
15 MINUTES EXPIRED ?
250
A

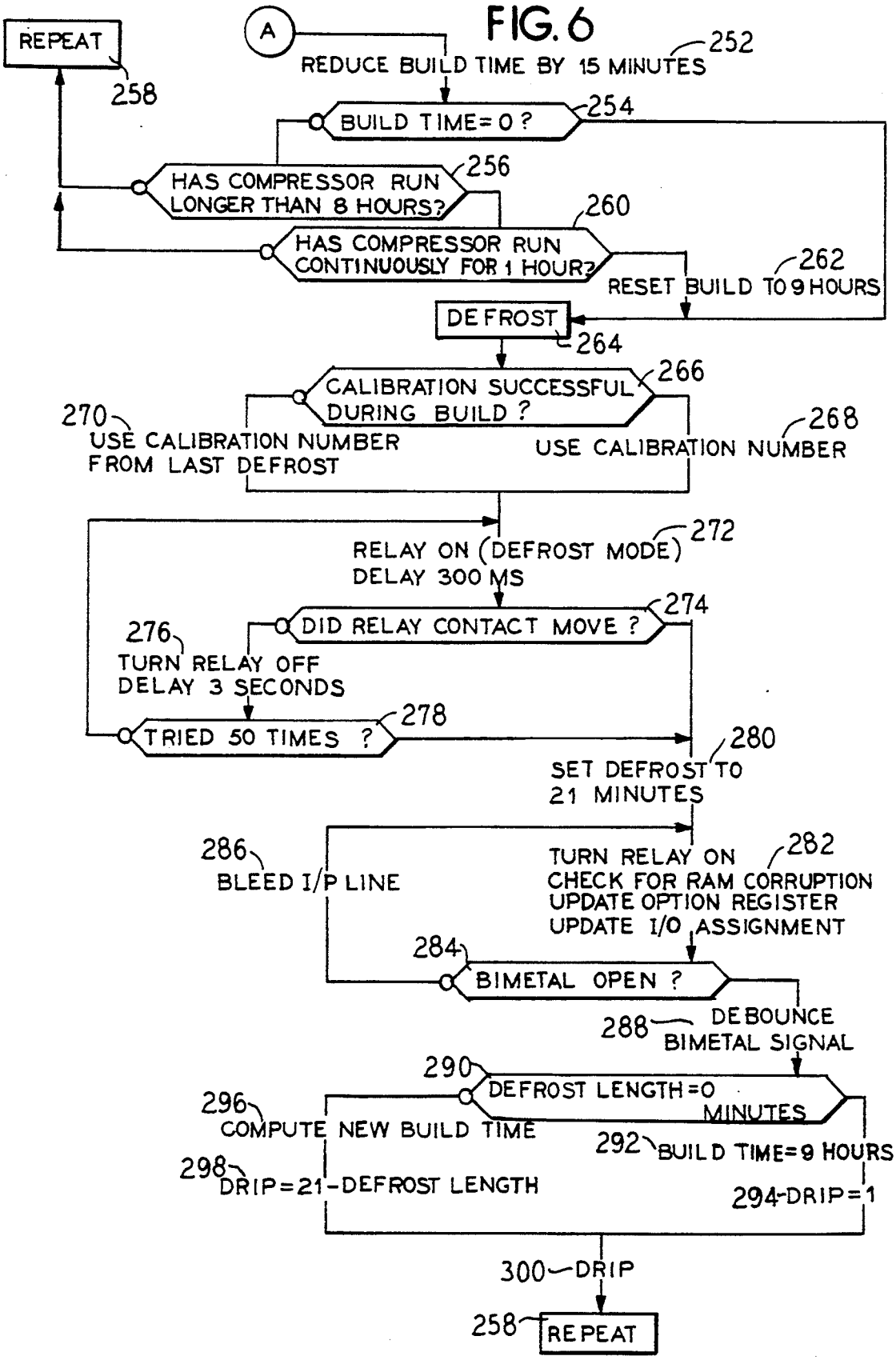
FIG. 6
A
REPEAT
258
REDUCE BUILD TIME BY 15 MINUTES
252
BUILD TIME=0 ?
254
HAS COMPRESSOR RUN LONGER THAN 8 HOURS?
256
HAS COMPRESSOR RUN CONTINUOUSLY FOR 1 HOUR?
260
RESET BUILD TO 9 HOURS
262
DEFROST
264
CALIBRATION SUCCESSFUL DURING BUILD ?
266
270
USE CALIBRATION NUMBER FROM LAST DEFROST
USE CALIBRATION NUMBER
268
RELAY ON (DEFROST MODE)
DELAY 300 MS
272
DID RELAY CONTACT MOVE ?
274
276
TURN RELAY OFF
DELAY 3 SECONDS
TRIED 50 TIMES ?
278
SET DEFROST TO 21 MINUTES
280
286
BLEED I/P LINE
TURN RELAY ON
CHECK FOR RAM CORRUPTION
UPDATE OPTION REGISTER
UPDATE I/O ASSIGNMENT
282
284
BIMETAL OPEN ?
288
DEBOUNCE BIMETAL SIGNAL
290
DEFROST LENGTH=0 MINUTES
296
COMPUTE NEW BUILD TIME
292
BUILD TIME=9 HOURS
298
DRIP=21-DEFROST LENGTH
294
DRIP=1
300
DRIP
258
REPEAT

RELAY ENERGIZING CIRCUIT

RELATED APPLICATION DATA

This is a division of application Ser. No. 07/978,275, filed Nov. 18, 1992, now U.S. Pat. No. 5,363,669.

BACKGROUND OF THE INVENTION

The present invention generally relates to refrigeration devices. Yet more particularly, the invention relates to defrost cycle controllers for refrigerators and freezers.

As is known, refrigerator and freezer systems, especially of the home appliance type, provide cooled air to an enclosure in which food and the like can be stored, thereby to prolong the edible life of the food. The enclosures, namely refrigerators and freezers, are cooled by air blown over heat exchangers, the heat exchangers extracting heat from the air thereby producing cooled air. The heat exchangers generally operate on the known cooling effect provided by gas that is expanded in a closed circuit, i.e., the refrigeration cycle. However, to be expanded, the gas must also be compressed and this is accomplished by the use of a compressor.

As is known, the efficiency of the systems can be enhanced by reducing the amount of frost that builds up on the heat exchanger. Modern systems are generally of the self-defrosting type. To this end, they employ a heater specially positioned and controlled to slightly heat the enclosure to cause melting of frost build-up on the heat exchanger. These defrost heaters are controlled pursuant to defrost cycle algorithms and configurations.

As a result, these freezers/refrigerators undergo two general cycles or modes, a cooling cycle or mode and a defrost cycle or mode. During the cooling cycle, a compressor is connected to a line voltage and the compressor is cycled on and off by means of a thermostat, i.e., the compressor is actually run only when the enclosure becomes sufficiently warm. During the defrost cycle, the compressor is disconnected from the line voltage and instead, a defrost heater is connected to the line voltage. The defrost heater is turned off by means of a temperature sensitive switch, after the frost has been melted away.

Generally, there are three known ways or techniques for controlling the operation of such a compressor and such a defrost heater with what is referred to herein as a defrost cycle controller. These three ways are referred to herein as real or straight time, cumulative time, and variable time.

The real time technique involves monitoring the connection of the system to line voltage. The interval between defrosts is then based on a fixed interval of real time.

The cumulative time method involves monitoring of the cumulative time a compressor is run during a cooling interval. The interval between defrost cycles is then varied based on the cumulative time the compressor is run.

The variable time method is the most recently adopted method and involves allowing for variable intervals between defrost cycles by monitoring both cumulative compressor run time as well as continuous compressor run time, and defrost length. The interval between defrost cycles then is based more closely on the need for defrosting.

As is known, during a defrost cycle there is also dripping of melted frost to a drip pan from which the melted frost evaporates. This is known as the drip mode or cycle and those terms are used herein.

Among others, the United States government has continuously enacted more and more stringent laws and regulations relating to the efficiency of refrigerators and freezers, particularly as home appliances. As a result, much research has been directed to more effective control over the refrigeration cycles of refrigerators and freezers and, particularly, to the defrost cycle, since in this cycle, the effect of refrigeration is, on the one hand, counteracted by removing cold from the enclosure, and on the other hand, enhanced by increasing the efficiency of refrigeration by removing insulating frost.

Patents directed to defrost controllers include:

| | |
|---|---|
| U.S. Pat. No. 4,156,350 | Refrigeration Apparatus Demand Defrost Control System and Method |
| U.S. Pat. No. 4,411,139 | Defrost Control System and Display Panel |
| U.S. Pat. No. 4,850,204 | Adaptive Defrost System with Ambient Condition Change Detector |
| U.S. Pat. No. 4,884,414 | Adaptive Defrost System |
| U.S. Pat. No. 4,251,988 | Defrosting System Using Actual Defrosting Time as a Controlling Parameter |

The teachings of these patents are incorporated herein by reference.

SUMMARY OF THE INVENTION

The present application provides one or more inventions directed to improvements in refrigeration/freezer defrost cycle controllers. These improvements can be provided in a single all-encompassing unit or practiced separately.

To this end, in an embodiment, there is provided a defrost cycle controller including a defrost timer unit operatively configured to provide for testing initialization of the controller via actuation of a thermostat. Preferably, turn on and off of a compressor via the thermostat a set number of times (preferably 3) during a pre-set interval (preferably 30 seconds) will trigger a test routine.

In an embodiment, there is provided a method of controlling a relay by means of which the life of the relay is extended. In this regard, the relay is first energized with a burst of voltage in excess of the rated voltage of the relay and then the energization voltage is allowed to rapidly decay to within the rated voltage of the relay, and preferably to the minimum holding voltage thereof.

In an embodiment, there is provided another method for prolonging the life of a relay under which a relay is first energized, the relay contacts are then monitored to verify a change of state, if the contacts do not change state, then power is removed from the relay and then following a rest period of a predetermined length, the procedure is recommenced.

In an embodiment, there is provided a defrost cycle controller for a freezer comprising a circuit operatively configured to control operation of a compressor and a defrost heater including a plug-in module that can be used either as a variable time controller, a real time controller, or a cumulative run time controller simply by selection of signals provided to the plug-in module.

In an embodiment, there is provided a defrost cycle controller wherein a compressor feedback signal line is tied to the power source via a pull-up resistor so that a default mode is provided wherein the controller is made to believe that the compressor is operating throughout the cooling cycle.

In an embodiment, there is provided a method by means of which sensitivity of the defrost cycle controller to frequent power outages can be reduced. In this regard, there is provided a modified initial defrost cycle that is performed upon power up of the defrost cycle controller if the freezer compartment is cold and the thermostat is open, i.e., the compressor is not requested to be turned on. However, if the thermostat is closed, the initial compressor run period will be reduced.

In an embodiment, there is provided a low cost low wattage power supply that allows the defrost controller to drive a relay yet maintain low energy consumption during the cycle. A capacitor is used to accumulate a charge through a high impedance sufficient to energize the relay. A second high impedance circuit provides voltage to the logic circuit. The natural impedance of a 5 volt system acts as a voltage divider for charging the capacitor. Once the relay is energized, the circuit provides for relay holding current through the normally open contact of the relay.

These and other features of the invention(s) will become clearer with reference to the following detailed description of the presently preferred embodiments and accompanied drawings.

BRIEF DESCRIPTION OF THE DRAWINGS

FIGS. 5 and 6 illustrate a more detailed flow diagram of the algorithm of FIG. 3.

DETAILED DESCRIPTION OF THE PRESENTLY PREFERRED EMBODIMENTS

As discussed above, there is provided a defrost controller including one or more features that, among other things, are particularly useful in increasing the efficiency of a refrigerator/freezer by controlling the defrost cycle, enhance the ability to test the operation of the controller, and can serve to extend the life of the controller by extending the life of relays used to control components associated with the refrigeration cycle.

Figure 1:
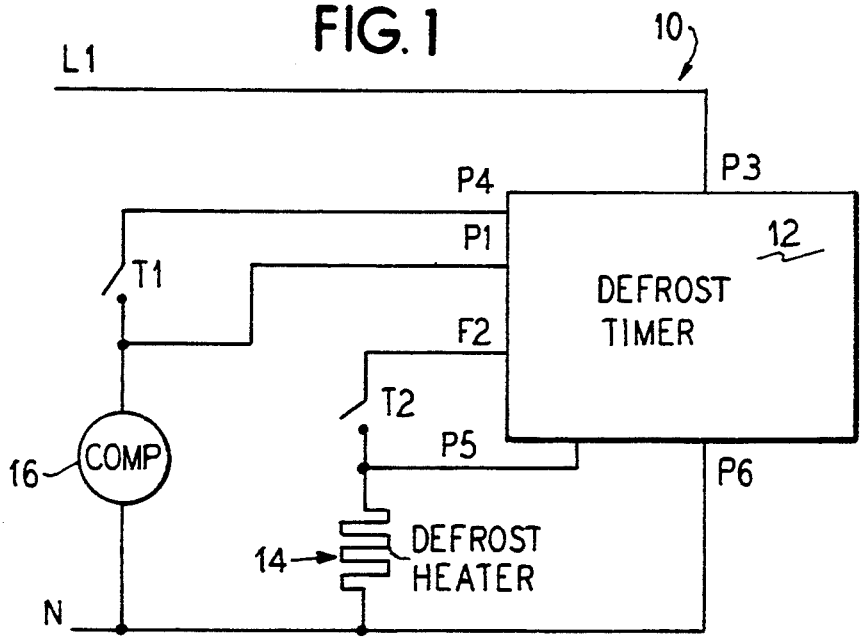
FIG. 1 illustrates a circuit diagram of a generic adaptive defrost controller embodying principles of the invention(s).

In FIG. 1 there is illustrated a defrost cycle controller 10 including a defrost timer module 12 that can embody principles of the invention. As illustrated, coupled between 110 volt alternating current power lines L1 and N is the defrost timer module 12, a defrost heater 14, and a compressor 16. The power line L1 is connected to the defrost timer module via a connection P3 and the power line N is connected to the defrost timer module 12 by means of a connection P6.

The defrost heater 14 is connected between the power line N and the defrost timer module 12 by means of a connection P5. Additionally, the defrost heater 14 is connected to a connection P2 via a bi-metal temperature sensitive switch T2.

Similarly, the compressor 16 is connected between the power line N and a connection P1 of the defrost timer module 12. Additionally, the compressor 16 is connected to a connection P4 of the defrost timer module 12 by means of a thermostat switch T1.

The defrost timer module 12, as will be explained below, preferably includes a microprocessor or application specific integrated circuit (a/k/a ASIC) or microcontroller, with inputs and outputs connected to, among others, the compressor 16 the defrost heater 14, the bimetal temperature switch T2 and thermostat T1.

As also will be described more fully below, the defrost timer module 12 preferably is provided as a plug-in module that can be connected to the compressor 16 and defrost heater 14 simply by plug-in connections. Thus, all components relating to the defrost timer module 12 would be located in the plug-in module except for the compressor 16, defrost heater 14 and associated thermostat switch T1 and bi-metal switch T2.

Figure 2:
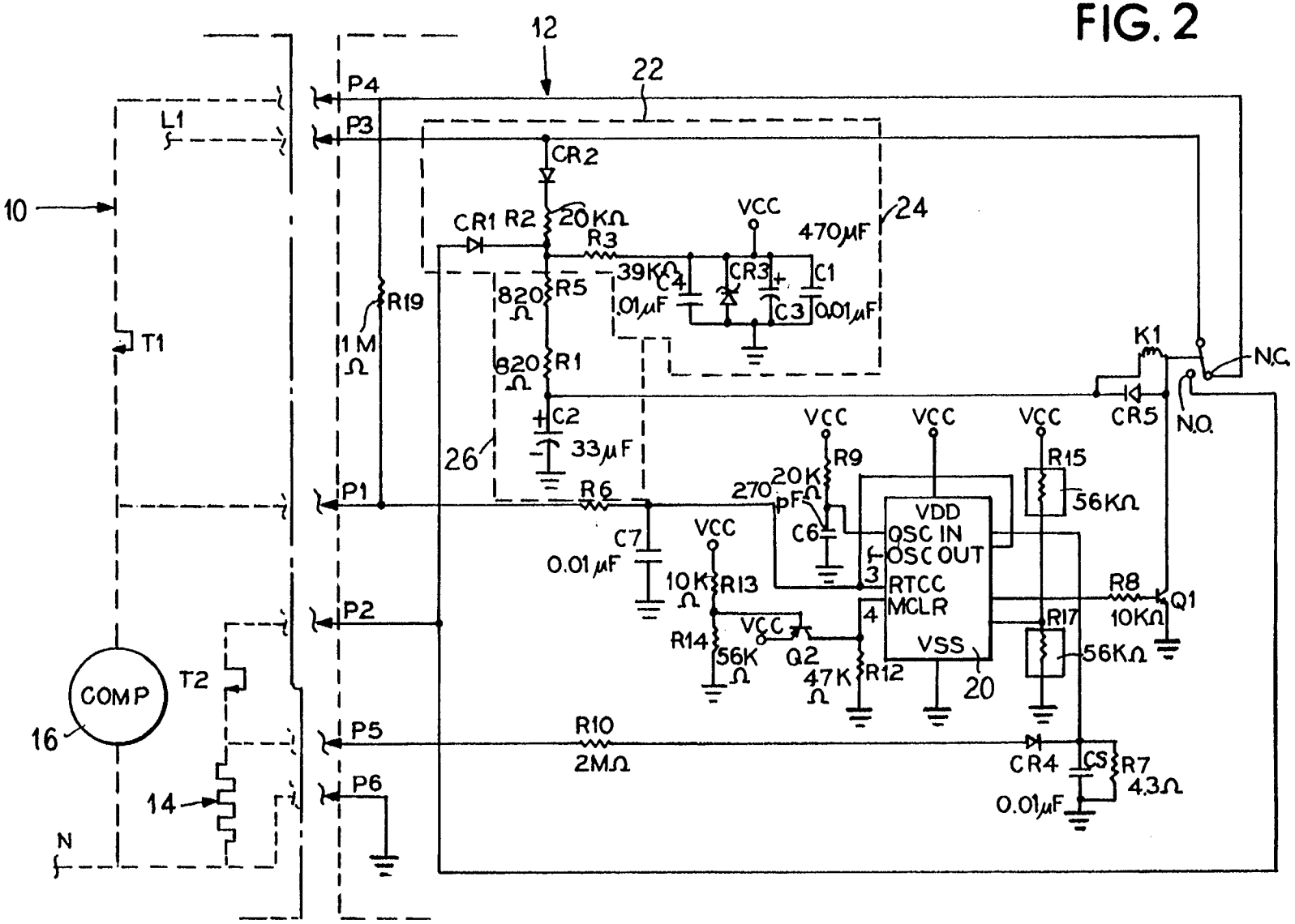
FIG. 2 illustrates a schematic of a defrost controller circuit embodying principles of the invention(s).

In FIG. 2 there is illustrated a schematic of a circuit implementable as the defrost timer module 12. The module 12 is illustrated in position for interconnecting with the defrost heater 14 and compressor 16 via plugs or connectors J1 and J2 formed by the individual connections P1 through P4 and P5 through P6, respectively.

As illustrated, the defrost timer module 12 can comprise a micro-controller or microprocessor or ASIC 20 operatively interconnected with various circuit elements to effect the operation demand for such a module. Preferably, the microprocessor 20 comprises a programmable integrated circuit sold under the designation PIC16C54-RC/P by Microchip Corporation. However, any economical micro-controller with sufficient memory will do.

The embodiment illustrated in FIG. 2, is depicted in a cooling mode for a freezer, i.e. wherein the circuit is not in a defrosting cycle and the compressor 16 is allowed to run. To this end, a control relay K1 is set accordingly with its normally closed contact NC closed so as to supply power from L1 to the compressor 16 via connections P4 and P3 while its normally open contact NO is open to prevent operation of the defrost heater 14.

In operation, the microprocessor 20 senses signals presented to it via connections P1 and P5 which inform the microprocessor 20 about the actual running of the compressor 16 and the actual operation of defrost heater 14. The microprocessor can then determine the cumulative and continuous run times of the compressor and defrost heater on time, thereby to determine how to alter the operation of those devices to obtain maximum efficiency and performance from the system associated therewith.

As is known, the thermostat switch T1 will cycle the compressor 16 on and off during the cooling period to maintain desired temperature. Similarly, the bi-metal switch T2 will turn the defrost heater 14 off upon completion of defrost. In this regard, a defrost interval preferably is set to be about 21 minutes, and the bimetal switch T2 opens at a predetermined temperature to end the heater on time remaining in the drip period. The bimetal switch T2 is not closed until the compressor has been run for a duration sufficient to cool the heater coils to a predetermined degree. However, the microprocessor 20 controls when the compressor 16 and the defrost heater 14 can operate, by switching between cooling and defrost cycles.

Although the actual algorithms employed by the microprocessor 20 may vary, generally such an algorithm will increase the interval between defrost periods depending on the cumulation and/or continuous on-time of the compressor and defrost heater time. Similarly, the on-time of the defrost heater 14 will be varied depending upon the amount of frost build up resulting from the continuous and cumulative run periods of the compressor 16.

In FIG. 2, power from the power line L1 is supplied to connection P3 from which it is then directed to a power supply circuit 22. Connection P4 is connected to the thermostat switch T1 associated with the compressor 16.

Power supply 22 essentially comprises two power supplies: a logic power supply 24 made up of resistor R3, zener diode CR3, and capacitors C1, C3 and C4; and a relay power supply 26 which comprises resistors R1 and R5 and capacitor C2. As illustrated, resistor R2, diode CR2, and diode CR1 are common to both the logic power supply 24 and the relay power supply 26. Resistor R2 is a high impedance resistor having a resistance on the order of 20K ohms while resistors R1 and R5 preferably have resistances of 820 ohms. Resistor R3 is preferably valued at about 39K ohms.

The logic power supply 24 generates an operating voltage VCC approximately equal to 5 volts which enables the microprocessor to start running. Meanwhile, capacitor C2 or relay power supply 26 charges to a value significantly higher than rated voltage. In the presently preferred embodiment, a charge of 55–60 volts was determined to be adequate. Resistors R2, and the impedance from logic power supply act as a voltage divider to limit the voltage on capacitor C2.

The relay power supply 26 provides a low-cost, low-energy usage power supply. This power supply allows the microcontroller 20, which typically requires a 5 volt power supply, to drive the relay K1, which typically requires 12–48 volts, while maintaining low energy consumption. In this regard, there are four main features to the configuration of the power supply 26, and those are:

1. To put the load that has the longest "on" time on the normally closed contact of the relay K1, this creating minimum energization time of the relay K1;

2. Use a capacitor (C2) to accumulate a charge to energize the relay K1 through high impedance resistors (R1, R2, R5), thus minimizing power supply losses while the relay isn't energized;

3. Use the 5 volt logic power supply impedance to act as a voltage divider for charging the capacitor C2; and 4. Once the relay K1 is energized, to provide relay holding current with the normally open contact (NO) of the relay K1 instead of high impedance resister R2.

In the embodiment illustrated in FIG. 2, diode CR2 rectifies the 110 volt alternating current line provided from line L1 thereby to provide rectified current for the 5 volt power supply while maintaining a charge on capacitor C2, while the relay K1 is off. Resistor R2 and the 5 volt side of the power supply circuit 26 create a voltage divider for proper voltage level to the capacitor C2. Diode CR1 rectifies the 110 volt alternating current supply voltage after the relay K1 energizes and provides additional current to the relay K1. The resistors R5 and R1 limit the current through the coil of the relay K1 while it is energized.

When the microprocessor 20 energizes the relay K1 by turning on a transistor Q1 connected thereto, the relay K1 is initially energized by a voltage across the capacitor C2. The defrost heater 14 is connected to the normally open contact NO of the relay 14, as illustrated. Thus, when the microprocessor 20 turns on the transistor Q1 and activates the relay K1, the relay K1 changes state to connect its common terminal with its normally open contact NO, thereby connecting line L1 with connection P2 thereby to energize the defrost heater 14. Connection line P2 is also connected to the power supply intermediate resistors R2 and R5 through rectifier CR1.

Once relay K1 changes state to connect its common terminal with its normally open contact NO, the alternating current line voltage from L1 is fed to the defrost heater 14 via connection P2 and the compressor 16 is disconnected from the line voltage L1. The line voltage is also applied to diode CR1, thereby bypassing the high impedance resistor R2 and energizing relay K1 thereafter through lower impedance resistors R1 and R5.

Because the voltage required to maintain the relay K1 in position is less than the voltage required to effect a change of state in the relay K1, this arrangement is appropriate and utilizes the known property of a relay to advantage. That is, the relay power supply 26 comprising resistors R1 and R5 and capacitor C2 is only engaged and, therefore, only dissipates power when the relay K1 is actuated. The relay power supply 26 provides a voltage that is less than the voltage required to actuate the relay K1.

Thus, the high impedance circuit including resistor R2 is employed during initial activation of the power relay K1, but the current flow through the power relay K1 is used to employ a lesser impedance circuit portion or segment for holding the relay K1 in its closed position.

In accordance with the first feature mentioned above, in order to save relay energy in a refrigerator, it is desirable to control the compressor with a normally closed contact. But, typically normally closed contacts are rated at lower current ratings than normally open contacts. Compressors can have high start-up currents, of up to 30 amps or more. Accordingly, a common failure mode of a relay, in an application such as that described herein, is for the normally closed contact to weld or stick in the closed position due to contact bounce. Thus, the use of a normally closed contact is disfavored.

In this regard, a feature of the invention to that end, is the overcoming of such welding or sticking of a relay. When energizing the relay K1, the relay K1 can be given a short burst of energy that exceeds its normal rating, for example 56 volts for one-quarter of a second. Thereafter, the energy applied to the relay K1 can be allowed to rapidly decay or drop down to within the rated voltage of the coil, generally about 24 volts. This burst of energy then can overcome the welding and extend the life of the relay.

In addition to or instead of the foregoing procedure, the light contact welding can be addressed by another feature or algorithm to prolong the life of a relay.

To this end, the microprocessor 20 can be programmed such that whenever the relay K1 is energized, the microprocessor controller 20 checks to verify that the contacts associated therewith change state, i.e., the NO contact is made while the NC contact is broken. If it can be determined that the contacts did not change state, the microprocessor 20 can remove power from the relay coil, wait an appropriate time, and repeat the process. This repetitive process has proven strong enough to break light contact welding of the normally closed contact NC associated with a relay K1. Therefore, the life of the relay K1 can be increased as contact wear begins to occur.

In implementing the foregoing, the presently preferred embodiments utilize feedback information relating to the status of the contacts NO and NC associated with the relay K1 provided via connection P1 to assist in the performance of this algorithm. Operation/non-operation of the compressor 16 is indicative of contact status. The state of this feedback signal provides information regarding the state of the relay K1 contact NC. In sum, the algorithm is as follows:

1. Energize relay K1 coil.
2. Monitor status of relay contacts.
3. If contacts do not move, remove power from the relay coil.
4. Allow relay power supply to be charged for a predetermined time period.
5. Repeat the foregoing process.

The microprocessor 20 is provided with two inputs via the connections P1 and P5, as also is illustrated in FIG. 2. Information regarding the compressor 16 is provided via the connection P1 while information about the defrost heater 14 is provided via connection PS.

The compressor 16 is monitored at connection P1 by means of the low pass filter comprising the resistor R6 and the capacitor C7 whenever the compressor is running. As should be apparent, the input will toggle whenever the compressor is running and not toggle whenever it is not running.

However, a possible failure mode for a defrost timing device, based on compressor run time, is to lose the compressor monitoring signal. If the signal is lost, for example due to a broken wire, loose connection, etc., the refrigerator may never be placed in a defrost mode. This could result in food loss, customer dissatisfaction, and a service call.

Another feature of the invention(s) is the generation of a default mode for such a failure. In this regard, the feature provides a default mode in which a lost compressor signal is ignored and the assumption is made that the compressor is operating 100% of the time K1 is not energized. This assumption results in no lost refrigerator performance, except for an increase in energy consumption. This default mode could also be service selectable for a back-up mode for worse case conditions, such as extremely high humidity areas.

To this end, voltage at connection P1 must be provided to indicate that the compressor is on. This can be accomplished, as illustrated by providing a pull-up resistor R19 coupled to tie the connection P1 to the line connecting the normally closed contact NC of the relay K1 to the connection P4. If the signal from the compressor is blocked from reaching the microprocessor 20 via connection P1, i.e., connection P1 becomes broken, the pull-up resistor R19 will provide a voltage to the microprocessor 20. If the compressor signal is provided, the impedance of the compressor 16 will cancel out the effects of the resistor R19.

It should be noted that the resistor R19 preferably is provided on the module 12 and thus can be considered internal to the defrost timing module 12, even though in reality, it could be a resistor simply mounted on a circuit board. In any event, the resistor R19 most preferably is connected internally to the module 12, else the signal provided by the resistor R19 could also be lost if the connection P1 is broken.

The microprocessor 20 preferably includes an internal watch dog and an internal power on reset circuitry. There is no need to signal condition the lines that monitor the alternating current signal supply to the compressor 16 and the power supplies 24 and 26 because the microprocessor 20 preferably includes a Schmitt trigger input with a built-in hysteresis on the line connected to connection P1. Line monitoring of the defrost heater 14 is treated as a direct current (DC) signal by the inclusion of a capacitor C5 which directs all alternating current signals on that line to ground.

In FIG. 2, the microprocessor 20 includes an input labeled "RTCC" which is an acronym for real time clock counter. It can be appreciated that when the compressor 16 is allowed to run, 60 Hz signals will be provided to the microprocessor 20 via connection P1. In this state, the microprocessor 20 can maintain track of real time and react accordingly.

Should the compressor be turned off, however, the 60 Hz timing signal will be lost, for example, during defrost and dripping.

Although initially it was considered necessary to monitor the alternating current at this portion, by providing 60 Hz timing information to the microprocessor 20 during defrosting and dripping, this requirement has been eliminated by performing an internal timing calibration via computer programming of the microprocessor 20. The microprocessor 20 thus detects failure of the relay K1 if 60 Hz information appears while the control circuit is in a defrost or drip mode. This internal timing calibration is described in greater detail below.

One feature of the invention(s) is a particular way to determine the need for a refrigerator or freezer to defrost based upon the length of time the compressor 16 runs continuously. This continuous run time can be variable based on the cumulative run time of the compressor 16. As a result, this can be referred to as demand defrost time.

To this end, the microprocessor 20 can be configured to include an algorithm to monitor when an extended run period after a default compressor run period has been reached. This information can be applied to utilize the algorithm to perform a demand defrost routine.

Essentially, this routine would allow the compressor 16 to run until an extended run period is encountered. The compressor would have no initial target, for example, no initial default target of 10 hours. Instead, target continuous run periods would be set based on the cumulative compressor run time. For example, if the cumulative compressor run time is 10 hours, then a continuous run time of 2 hours would trigger a defrost. As the cumulative run time increases, the continuous run time that would trigger a defrost cycle would decrease. An example is shown in the following table:

| Cumulative Compressor Run Time | Continuous Run Period For Triggering Defrost Cycle |
|---|---|
| 0–10 hours | Not applicable |
| 10–15 hours | 2 hours |
| 15–20 hours | 1.5 hours |

-continued

| Cumulative Compressor Run Time | Continuous Run Period For Triggering Defrost Cycle |
|---|---|
| 20 or more hours | 1 hour |

While this algorithm presents the risk of an increase in the chance that frost will build up on an evaporator coil because the initial cumulative and continuous compressor run periods would be long, it should also be more energy efficient because initially there generally is little frost build-up.

In a modified version of this concept, a cumulative run time of 8 hours will set a continuous run period of 1 hour for triggering a defrost cycle.

Another feature of the invention(s) is to configure the defrost timer module 12 as a fixed time cumulative run timer by removing or disconnecting the contact P5 by means of which the defrost heater 14 and bi-metal switch T2 are monitored. In this regard, generally in order for the timer 12 to perform properly it must receive input signals from the compressor 16 and the defrost heater 14. Monitoring of the signal from the defrost heater provided by a contact P5 informs the microprocessor 20 how long the bi-metal switch T2 took to open once a defrost cycle had been started. This information then is used to predict the next run period of the compressor 16.

If upon entering the defrost mode the microprocessor 20 does not detect that the hi-metal switch T2 is closed and then opened, the length of the defrost period will not be available to calculate the next run period of the compressor 16. The microprocessor 20 will then have to revert back to a default run setting. Therefore, to keep the microprocessor 20 at the default run time period of the compressor 16, the feedback provided via contact P5 from the defrost 12 should be disconnected. This will cause the defrost time module 12 to perform as a fixed time cumulative run timer.

Figure 4:
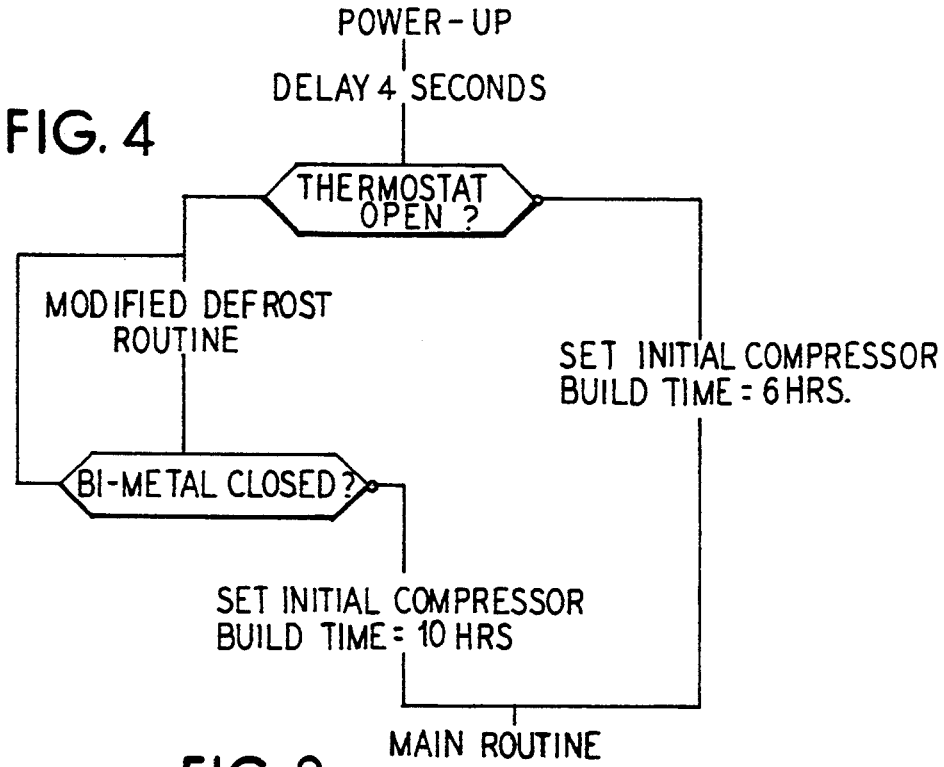
FIG. 4 illustrates a flow diagram of another algorithm employed in the circuit of FIG. 2.

Illustrated in FIG. 4 is another feature of the invention(s). As discussed above, certain areas of the country are prone to frequent power outages. This can result in a malfunction of certain types of electronic controls. Therefore, many will include a device to maintain the memory of the controller such as a battery or supercapacitor. If the present control system is subjected to a series of outages, a potential frost build-up could occur in the freezer and/or refrigerator associated therewith.

To this end, the sensitivity of the defrost timer 12 to frequent power outages can be reduced by modifying the power up algorithm of the microprocessor. To this end, the power up routine can be modified so that if the microprocessor 20 powers up to find the unit is cold and the thermostat switch T1 is open, the microprocessor 20 can perform an initial modified defrost routine. However, if the microprocessor 20 powers up to find a unit with a closed thermostat switch T1, the initial compressor run period will be reduced.

As illustrated in FIG. 4, when the controller 20 powers up, it monitors the status of the feedback signals from the refrigerator/freezer at P1 and P5 to determine the status of the unit. If the refrigerator/freezer can be determined to be cold, i.e., the bi-metal T2 is closed, and the thermostat T1 is not calling for cold, i.e., the thermostat is open, then the controller 20 will perform a modified defrost cycle. This modified defrost cycle will not include a drip period as skipping such a drip period will minimize the time until the compressor 16 begins to run. After this modified defrost cycle, the next compressor build time will be set at a default value, for example such as 8 hours.

However, if the unit powers up to see that the unit is calling for cold, i.e., thermostat T1 is closed, then an initial defrost will not occur, this insuring that when a customer first plugs in the unit, the compressor will run to show that the unit is functioning, but the initial compressor build time will be set to a lower value, such as six hours.

The foregoing reduces the time window of a power outage that could disrupt the performance of the controller. The value of this reduced build time is a function of expected frequency of the power outages and the "pull down" performance specification of the refrigerator. If the initial compressor build time is too short, the time to cool a warm refrigerator will be extended because a defrost will occur too soon.

Many electronic control systems require a test switch for the testing of a controller for controls during manufacturing and/or use. Another feature of the invention, as discussed above, is an algorithm that allows testing of the control system within a time window allowed during assembly and also to verify complete function of the control system during use.

In this regard, to test operation of the defrost controller and to allow testing of a refrigerator associated therewith, the refrigerator is powered up with the thermostat T1 open and the bi-metal T2 shorted with a conventional test connector. This will cause the controller to switch into the modified defrost routine described above when the relay K1 is energized and the microprocessor 20 looks for the feedback signal from the defrost heater 14. If a signal appears, then that wire is assured to be present. The controller will then watch for the bi-metal switch T1 to open, at which time the defrost heater feedback signal will go low. When this happens, the control then de-energizes the relay K1 which allows the compressor 14 to run. However, if the defrost signal is not high when entering the modified defrost routine, the controller will switch the relay K1 off. This will not allow the wattage measurement of the defrost heater 12 to occur. This will act as a signal that the controller is not functioning properly or that the feedback wire is not connected.

For various reasons including the obvious advantage of decrease in cost, no test switch is provided in the illustrated circuit. Instead, a test mode can be entered by opening and closing the control thermostat associated with switch T2 in an acceptable pattern. In this regard, for example, the thermostat can be closed three times within 30 seconds to signal actuation of a test routine.

Figure 3:
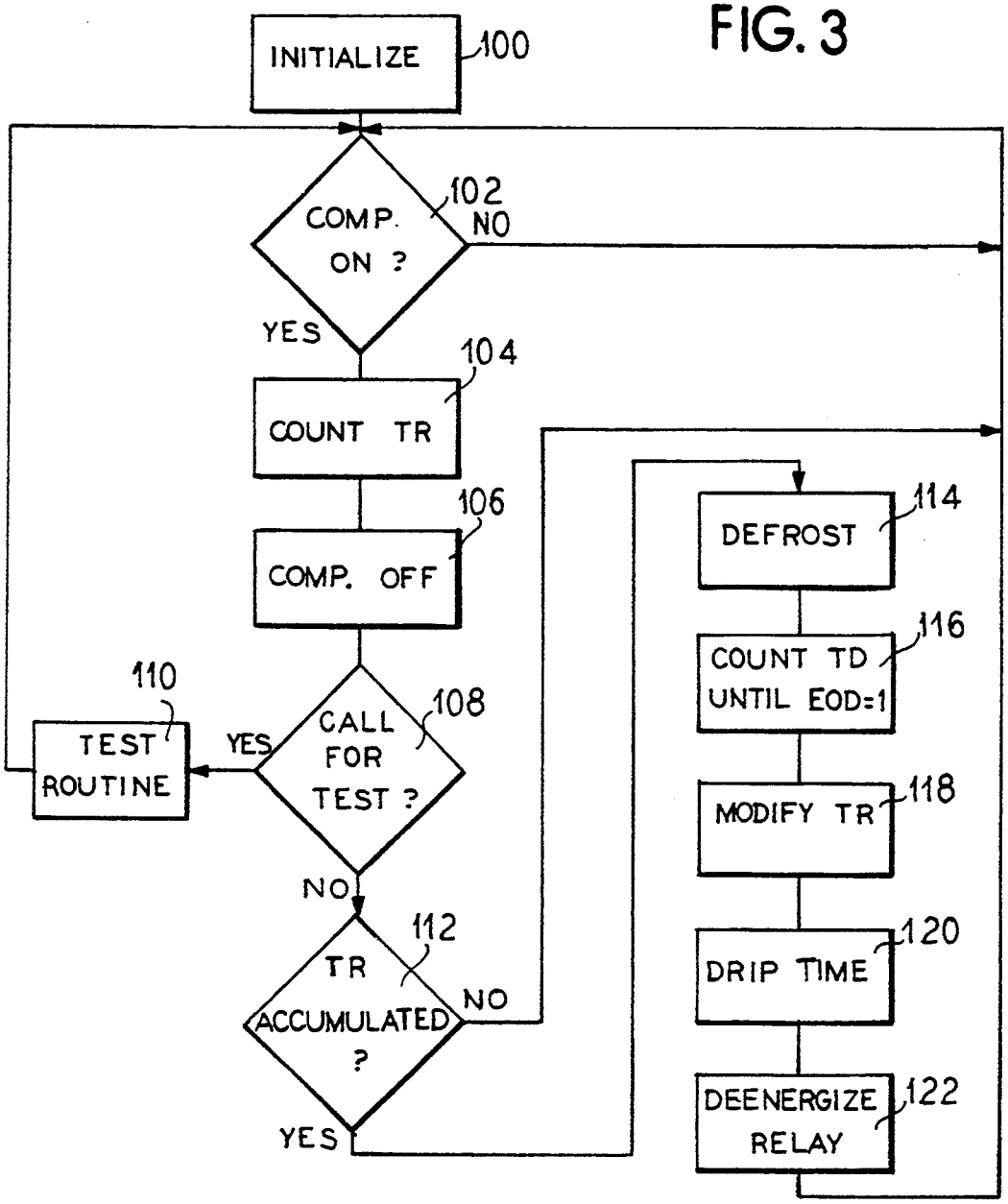
FIG. 3 is a flow chart of an algorithm employed in the circuit of FIG. 2.

In FIG. 3 there is illustrated a flow chart of logic that can be programmed into the microprocessor 20 to effect the normal operation of the defrost timer 12. As illustrated, after the microprocessor 20 has undergone an initialization procedure, for example setting variables, etc., in a first step 100, a determination is made as to whether or not the compressor is on in a step 102. At this juncture, the microprocessor senses whether or not a signal is present at connection P1. If the determination is positive, i.e., the answer is yes, then the run time of the compressor is counted and accumulated in a step 104. If the answer is no, then the microprocessor remains in a loop, i.e. it returns to step 182, until such time as the compressor is turned on by the switch T1. As illustrated by block 106, once the compressor is turned off by switch T1 thereafter, in a step 108, an inquiry is made as to whether a test routine has been called for, for example by the switching on and off the compressor via the thermostat switch T1, as described above. If a test routine is called for, then the test routine is executed as indicated by the block 110. Once the test routine is completed, the microprocessor 20 loops back to step 102.

If a test routine had not been called for, then in a step 112 a determination is made as to whether or not the cumulative run time of the compressor has been reached. If the answer is no, then the microprocessor loops back to step 102 and waits until the compressor is again turned on by the thermostat T1.

If the cumulative run time of the compressor has been reached, then the microprocessor enters into a defrost mode as indicated by block 114. At the same time, the total defrost time is counted as indicated by block 116 until an end of defrost period is reached. At that point, as indicated by block 118, the run time of the compressor is modified in view of the on time of the defrost heater 14.

As indicated by block 120, a drip time follows the defrost time during which the melted frost is allowed to drip off the heat exchanger.

Thereafter, as indicated by block 122, the relay K1 is de-energized and then the microprocessor returns to step 102.

In FIGS. 5 and 6 another flow diagram of an algorithm for controlling the system of FIG. 2 is illustrated. This flow diagram essentially is a more detailed version of the algorithm of FIG. 3.

As illustrated, when a system employing the circuit of FIG. 2 is first plugged in and turned on, the microprocessor 20, or other suitable controller, will commence a control algorithm 200 at an initial step 202 title "BEGIN".

As a first step 204 thereafter, the algorithm includes a delay sufficient to allow for an internal memory check. In this internal memory check, the memory associated with the microcontroller is tested to determine that it is in a functional state. Thereafter, in a step 206 a determination is made as to whether the thermostat switch T1 is open.

If the thermostat switch T1 is not open, then in a step 208 the compressor run time is set to an initial 6 hours. If the thermostat switch T1 is open, then in a step 210, the defrost cycle is tested and in a subsequent step 212, the compressor run time is set to 8 hours.

After the compressor is set to either 6 or 8 hours, in a step 214, the algorithm enters into a relay off or cooling mode, also identified as a compressor mode. In this mode, the compressor is allowed to run.

As discussed above, when the compressor is turned off, i.e., during a defrost and drip period, the microprocessor will lose its real time input and will be unable to keep track of real time. To overcome this, the microprocessor is calibrated by way of a software routine so that during a defrost and drip period, the microprocessor 20 can approximately keep track of real time.

To this end, the microprocessor undergoes what is referred to herein as an RC calibration routine.

As described above, the operating frequency of the microprocessor is established by R9 and C6 with R9 selected to be 20K ohms and C6 selected to be 270 pF, a target frequency of 150K Hz is established at the OSC input of the microprocessor 20. With a variation of +40%/−31%, a maximum operating frequency of about 210K Hz and a minimum operating frequency of about 104K Hz are established.

Before the compressor is run, a determination is made as to whether it is necessary to calibrate the internal timing of the microprocessor 20 as described previously. Accordingly, if a calibration has not been run, then it is necessary to determine timing provided by the RC network so that timing can be maintained in the microprocessor when no real timing signal is present.

Accordingly, in a first step 216, a determination is made as to whether the timing calibration complete. If not, then a determination is made as to whether or not a first calibration is complete. To ensure that a calibration is made then two readings are undertaken and the calibration process is not terminated until two equal readings are obtained. Accordingly, if the first "reading" is complete as determined in step 218, then the calibration process continues to a step 220 to determine whether or not a second "reading" is complete. If the first reading is not complete, then the calibration, i.e. a "reading" is undertaken in a step 224 for one second. The algorithm then exits the calibration routine without a setting a calibration flag.

In a "reading" step, the microprocessor executes a delay loop for a period of one second. The number of executions of the loop becomes a measure or "reading" of the operating frequency established by R9 and C6. For example, the following table summarizes possible narrations.

| Frequency | 210k Hz | 104k Hz | 150K Hz |
|---|---|---|---|
| instruction cycle Time | 19μ | 38μ | 27μ |
| Time for delays | 4.0 mS | 8.1 mS | 5.6 mS |
| Count for RC calibration (# of loop executions) | 250 | 123 | 178 |

If the first "reading" was complete, then, as stated above, a second "reading" is undertaken in a step 220. If the second "reading" is not complete then a second calibration for one second is undertaken in a step 228. Following that second calibration, the algorithm continues out of the calibration routine.

If the second "reading" is determined to be complete in step 220, then a determination is made as to whether or not the first and second readings are equal in step 226. If the first and second readings are equal, i.e., the number of loop executions are the same, then calibration is determined to be complete and RC calibration flag is set in a step 234. From there, the algorithm continues out of the calibration procedure. However, if it is determined in the step 226 that the first and second readings are not sufficiently equal, then all the values set during the calibration procedure are cleared in a step 230, and then in a step 232 it is determined that the calibration process should be started over.

In any event, the algorithm continues out of the calibration procedure to the main adaptive defrost control portion of the algorithm. As will be made clear below, depending on the state of the timing calibration, i.e. is only a first reading is complete or both the first and second readings are complete or the RC calibration flag is set, will determine how the algorithm proceeds through this control section.

As further illustrated in FIG. 5, before the algorithm enters into the main control procedures, in a step 236, a 15 minute timer is cleared as are all test mode counters.

Subsequently, in a step 238, the algorithm continues with the main control procedures.

As a first step 240 in the main control procedure, the compressor is turned on and a variety of input output assignments and other option registers are updated. Thereafter, in a step 242, a check is made to determine whether the random access memory associated with the microprocessor 20 has been corrupted. If the random access memory has been corrupted, i.e. there are errors therein, then the routine returns to the beginning step 202. If no corruption is detected, then the algorithm continues to a step 244 to determine whether the compressor is actually running. At the same time, in a step 246, a determination is made as to whether or not the service test mode has been requested. If yes, then the branches over to step 248 to commence the test routine in step 210 described above.

If the service test mode has not been requested in step 246, then the algorithm continues to step 250 to determine whether or not 15 minutes has expired of the compressor run time. If not, then the routine returns to step 238 to cycle through this portion of the algorithm again.

If the 15 minutes of compressor run time described above has expired, then the algorithm continues to step 252 wherein the compressor build time counter is reduced by 15 minutes.

Thereafter, in a step 254, determination is made as to whether or not the build time counter has reached zero, If not, a determination is made in a step 256 as to whether the compressor has run longer than 8 hours. If not, then the algorithm proceeds to a step 258 titled "REPEAT" which will branch the algorithm back to step 214. If compressor has run longer than 8 hours, then a determination is made as to whether the compressor has run continuously for more than 1 hour in a step 260. If not, then the algorithm branches out to the repeat step 258 as described above. If the compressor has run continuously for more than 1 hour, then the algorithm proceeds to a step 262 at which the build time is set to 8 hours. From there, the algorithm continues to defrost step 264. As also illustrated in FIG. 6, if the build time counter is determined to be reduced to zero in step 254, then the algorithm also proceeds to this step 264.

From the step 264, the algorithm continues to step 266 at which is determined whether a successful calibration has been achieved during the compressor build time. If it is determined that a successful calibration has not been achieved, i.e. the calibration flag is not set in step 234, then in a step 270, the system is set to use a calibration number from the last defrost cycle.

Alternatively, if it is determined in step 266 that the calibration was successful during the compressor build then the algorithm continues to step 268 at which the system is set to use the new calibration RC calibration number.

Following either step 268 or 270, the algorithm continues to step 272 at which the relay is turned on and a system delay of 300 milliseconds is undertaken.

Thereafter, in a step 274, a determination is made as to whether or not the relay contact had moved. If the relay contact had not moved, then the relay is turned off for a period of three seconds in a step 276.

Thereafter, in a step 278, a determination is made as to whether 50 attempts to turn the relay on have been undertaken. If not, then the algorithm cycles through the series of steps 272, 274 and 276 again.

If, in step 274 it is determined that the relay contact did move or if in step 278 it is determined that 50 attempts to turn the relay on have been undertaken, then the algorithm continues to step 280 at which point, the defrost is set to a period of 21 minutes. Thereafter, in a step 282, the relay is again turned on and a check is made as to whether or not the random access memory of the microprocessor has been corrupted and an update of the option registers as well as the input/output assignment is undertaken.

Thereafter, in a step 284, a determination is made as to whether or not the bimetal switch T2 is open. If the bimetal switch T2 is not open, then in a step 286, the I/P line is allowed to bleed.

If the bimetal switch T2 was determined to be open in step 284, then the algorithm continues to a step 288 at which point a debouncing of the bimetal signal is undertaken. Such debouncing techniques are known. Thereafter, in a step 290, a determination is made as to whether or not the defrost time was 0, 1 or 21 minutes. If the defrost time was 0, 1 or 21 minutes, then the build time is reset to 8 hours in a step 292 and a drip time of one minute is set in a step 294.

If the defrost time was not 0, 1 or 21 minutes, then in a step 296, a new build time is computed in accordance with the parameters set forth above. At the same time, a new drip time of 21 minutes minus the defrost time remaining is set in a step 298.

After either step 298 or 294, the algorithm continues to a step 300 during which the system undertakes a drip period as computed in either step 298 or 294.

Thereafter, the algorithm continues to the repeat step 258 and again cycles through the algorithm as set forth above, i.e. recommencing with step 214.

Figure 8:
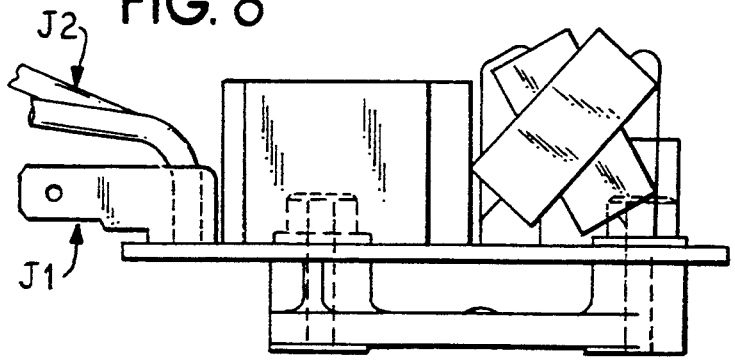
FIG. 8 is a side view of the circuit board of FIG. 7.
Figure 7:
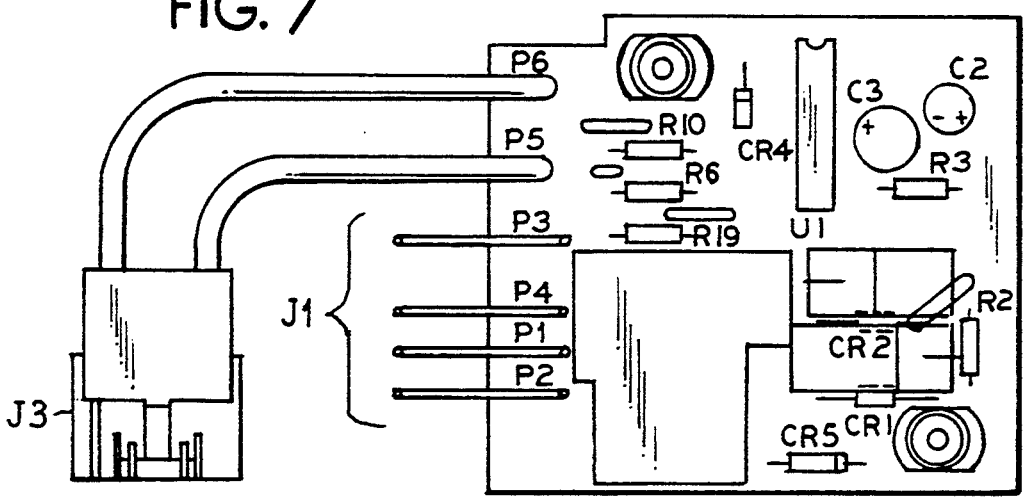
FIG. 7 illustrates a circuit board including circuit elements in a defrost controller embodying principles of the invention.

In FIGS. 7 and 8, it can be seen how a defrost timer module 12 can be provided on a plug-in circuit board with connectors J1 and J2 operatively positioned for connecting to terminals associated with the compressor 16 and defrost heater 14. Because of its plug-in modularity, the module 12 would then be ideally suited for a variety of applications if easily reconfigurable.

To this end, as described above, by disconnecting the connection to P1 or P5, the module 12 will react either as a real or straight time timer or a cumulative run timer, thus, breaking of connection P1 and turn the module 12 into a real time defrost timer. Similarly, connection P5 will turn the module 12 into a cumulative time timer.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method for energizing a relay, comprising the steps of:

generating a first supply current;

storing a relay energization charge;

coupling the relay to the first supply current and the relay energization charge to energize the relay, in combination the first supply current and the charge being provided at a voltage in excess of a rated voltage of the relay, the charge decaying over a predetermined time period; and immediately thereafter decoupling the relay from the first supply current and instead coupling the relay to a second supply current via a normally open contact of the relay, the second supply current being provided at a voltage less than the rated voltage of the relay.

2. The method of claim 1, comprising the step of providing the relay in a freezer defrost timer circuit.

3. The method of claim 1, wherein the relay is rated at 24 volts and the energization signal is initially applied at about 55 volts.

4. The method of claim 1, wherein the energization signal decays to within the rated voltage of the relay within about 30 milliseconds.

5. A power supply for a relay, comprising:

first means coupled between an alternating current supply and the relay for rectifying the alternating current;

second means for storing relay energization charge operatively coupled to the first means and the relay; and third means coupled between the alternating current supply and the relay for rectifying the alternating current;

whereby the relay has a normally open contact coupled to the third means such that upon energization of the relay, the third means is connected to the relay to provide a sufficient extra current to the relay that the relay is held in an energized state.

6. The power supply of claim 5, further comprising a sub-power supply circuit coupled to the first means, the sub-power supply circuit configured to generate a low voltage output from the rectified current suitable for powering an electronic logical device.

7. The power supply of claim 5, wherein the first and third means comprise diodes.

8. A power supply for supplying power from an alternating current supply to a relay, comprising:

a first current rectifier coupled between the AC supply and the relay;

a charge storage capacitor having one end coupled to a point lying between the first rectifier and the relay;

a low voltage power supply circuit having an input coupled to a point lying between the one end of storage capacitor and the first rectifier;

a relatively high impedance coupled between the first current rectifier and the input of the low voltage power supply output; and a second rectifier coupled between the one end of the charger storage capacitor and the AC supply;

whereby the relay has an input coupled to the one end of the charge storage capacitor and the second rectifier is coupled to normally open contacts of the relay so that upon energization, the second rectifier is activated to direct rectified current to said relay.

9. The power supply of claim 8 whereby the first and second rectifiers use diodes.

10. The power supply of claim 8 wherein the low voltage power supply circuit is configured to produce a five volt d.c. output voltage.

11. The power supply of claim 8 wherein the relatively high impedance is a 20K ohm resistor.

* * * * *